US005152680A

United States Patent [19]

Okada

[11] Patent Number: 5,152,680

[45] Date of Patent: Oct. 6, 1992

[54] TRANSFUSION PUMP

[75] Inventor: Shigeru Okada, Fujinomiya, Japan

[73] Assignee: Terumo Kabushiki Kaisha, Tokyo, Japan

[21] Appl. No.: 865,635

[22] Filed: Apr. 9, 1992

Related U.S. Application Data

[63] Continuation of Ser. No. 774,301, Oct. 10, 1991, abandoned, which is a continuation of Ser. No. 554,866, Jul. 20, 1990, Pat. No. 5,088,904.

[30] Foreign Application Priority Data

Jul. 24, 1989 [JP] Japan ..... 1-188907

[51] Int. Cl.[5] ..... F04B 43/12

[52] U.S. Cl. ..... 417/474; 604/153

[58] Field of Search ..... 417/474, 475, 476, 477; 604/153; 128/DIG. 12

[56] References Cited

U.S. PATENT DOCUMENTS

| | | | |
|---|---|---|---|
| 4,561,830 | 12/1985 | Bradley | 417/474 |
| 4,648,812 | 3/1987 | Kobayashi et al. . | |
| 4,725,205 | 2/1988 | Cannon et al. | 417/474 X |
| 4,728,265 | 3/1988 | Cannon | 417/474 X |
| 4,755,109 | 7/1988 | Botts | 417/474 X |
| 4,869,646 | 9/1989 | Gordon et al. | 417/474 X |
| 4,909,710 | 3/1990 | Kaplan et al. | 417/474 X |
| 4,954,046 | 9/1990 | Irvin et al. | 417/474 X |

FOREIGN PATENT DOCUMENTS

| | | |
|---|---|---|
| 283614 | 9/1988 | European Pat. Off. . |
| 546884 | 7/1930 | Fed. Rep. of Germany . |
| 2939212 | 6/1980 | Fed. Rep. of Germany . |
| 909631 | 5/1946 | France . |
| 2425562 | 12/1979 | France . |
| 2475646 | 8/1981 | France . |
| 85593 | 5/1986 | Japan . |

*Primary Examiner*—Leonard E. Smith

*Attorney, Agent, or Firm*—Burns, Doane, Swecker & Mathis

[57] ABSTRACT

A transfusion pump includes a housing disposed to oppose a tube filled with a liquid to be supplied, a plurality of fingers mounted on the housing along a liquid supply direction to urge the tube, a drive shaft for pivotally reciprocally supporting the tube in a direction to urging the tube, cams engaged with the fingers rotatably supported by the drive shaft, a drive motor for sequentially driving the cams so that the fingers which are engaged with the corresponding cams sequentially urge the tube in the liquid supply direction, and a biasing member, arranged to be engaged with the fingers, for biasing the fingers to be in contact with the corresponding cams.

6 Claims, 4 Drawing Sheets

TRANSFUSION PUMP

This application is a continuation of application Ser. No. 07/774,301, filed Oct. 10, 1991, now abandoned, which is a continuation of application Ser. No. 07/554,866, filed Jul. 20, 1990, now U.S. Pat. No. 5,088,904.

BACKGROUND OF THE INVENTION

The present invention relates to a transfusion pump having a pivotal finger for urging a tube for supplying a liquid in the tube.

A conventional technique disclosed in Japanese Patent Laid-Open No. 61-85593 is known as a conventional transfusion pump having a plurality of pivotal fingers to peristaltically drive the fingers. In this prior art, a pair of projections constituting a fork-like shape is integrally formed at the rear end of each finger to pivot the finger. An eccentric disc cam is clamped between the projections, and the finger is reciprocally pivoted upon eccentrical pivotal movement of the cam.

In this conventional transfusion pump having the above arrangement, however, a predetermined clearance is required between the eccentric disc cam and both the projections in order to allow an eccentrical pivotal movement of the eccentric disc cam. As a result, cluttering occurs between the eccentric disc cam and the finger although it is slight.

When the eccentric disc cam changes its urging direction from a direction to come close to and urge a tube through a finger to a direction to be separated to release the urging force, the finger is not pivoted upon pivotal movement of the eccentric disc cam by a stroke corresponding to the cluttering play. As a result, the liquid in the tube is not appropriately fed in a liquid supply direction, resulting in inconvenience.

SUMMARY OF THE INVENTION

The present invention has been made in consideration of the above situation, and has as its object to provide a transfusion pump which can appropriately supply a liquid in a tube.

In order to solve the conventional problems described above and to achieve the above object, according to a first aspect of the present invention, there is provided a transfusion pump comprising a housing disposed to oppose a tube filled with a liquid to be supplied, a plurality of fingers mounted on the housing along a liquid supply direction to urge the tube, pivoting means for pivotally reciprocally supporting the tube in a direction to urge the tube, cams engaged with the fingers rotatably supported by the pivoting means, driving means for sequentially driving the cams so that the fingers which are engaged with the corresponding cams sequentially urge the tube in the liquid supply direction, and a biasing member, arranged to be engaged with the fingers, for biasing the fingers to be in contact with the corresponding cams.

According to a second aspect of the transfusion pump of the present invention, the biasing member comprises elastic pieces mounted on the housing in correspondence with the fingers, respectively.

According to a third aspect of the transfusion pump of the present invention, the biasing member comprises elastic pieces which are integrally formed with the fingers, respectively, and distal ends of which are in elastic contact with the housing.

According to a fourth aspect of the transfusion pump of the present invention, the housing is movably supported along the tube urging direction, and the transfusion pump further comprises a second biasing member for urging the housing in the tube urging direction.

According to a fifth aspect of transfusion pump of the present invention, the housing is pivotally rotated about a pivot shaft which axially supports the fingers, and the second biasing member comprises a torsion coil spring which is wound around the pivot shaft and one end of which is locked by the housing.

According to a sixth aspect of the transfusion pump of the present invention, the transfusion pump further comprises an adjusting screw connected to the other end of the torsion coil spring and reciprocated to adjust a biasing force of the torsion coil spring.

According to a seventh aspect of the transfusion pump of the present invention, the transfusion pump further comprises at least one pulsation preventive finger located adjacent to the fingers and opposite to the tube, and a pulsation preventive cam in contact with the pulsation preventive finger to drive the pulsation preventive finger so as to prevent pulsation during liquid supply, thereby pushing the tube.

According to an eighth aspect of the transfusion pump of the present invention, the pulsation preventive finger is pivotally supported by the pivoting means.

According to a ninth aspect of the transfusion pump of the present invention, the fingers respectively have projections, and the cams are engaged with the projections of the fingers, respectively.

As described above, since the transfusion pump according to the present invention has the above arrangement, at the time of driving of the cams by the driving means, fingers are urged by the advancing cams, and the tube is urged by the fingers. At the time of backward movement of the cams, the fingers are normally in contact with the corresponding fingers by the biasing forces of the corresponding biasing members. In this manner, the fingers are kept in contact with the cams. As a result, the fingers urge the tube in accurate synchronism with movement of the corresponding cams, thereby appropriately supplying the liquid in the tube.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

An arrangement of a transfusion pump according to an embodiment of the present invention will be described in detail with reference to FIGS. 1 to 4.

Figure 1:
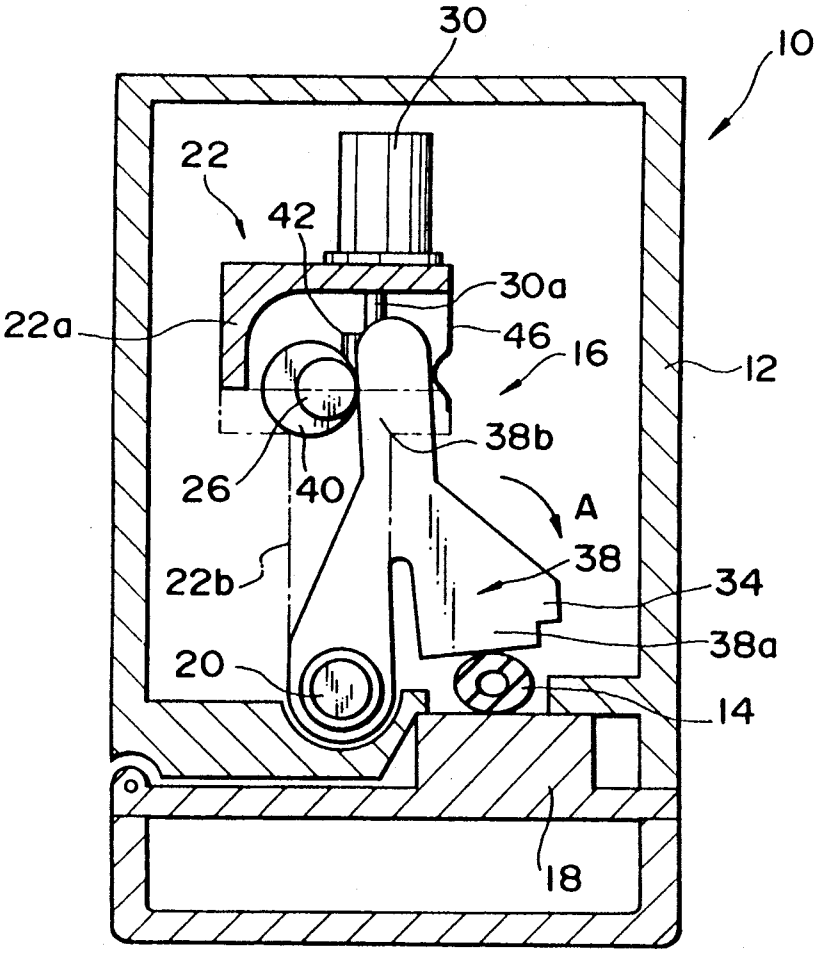
FIG. 1 is a sectional plan view showing an arrangement of a transfusion pump according to an embodiment of the present invention.

As shown in FIG. 1, a transfusion pump 10 according to an embodiment comprises a body 12, a tube 14 mounted to vertically extend through the body 12 and filled with a liquid to be supplied, and a liquid supply mechanism 16 for supplying the liquid in the tube 14 from the upper direction to the lower direction. The body 12 has an open front surface (the upper surface side in the illustrated state) which is entirely closed by a tube mounting plate 18. The tube 14 is mounted on the inner surface of the tube mounting plate 18 to vertically extend so that upper and lower ends of the tube 14 which are located within the body 12 are locked.

Figure 2:
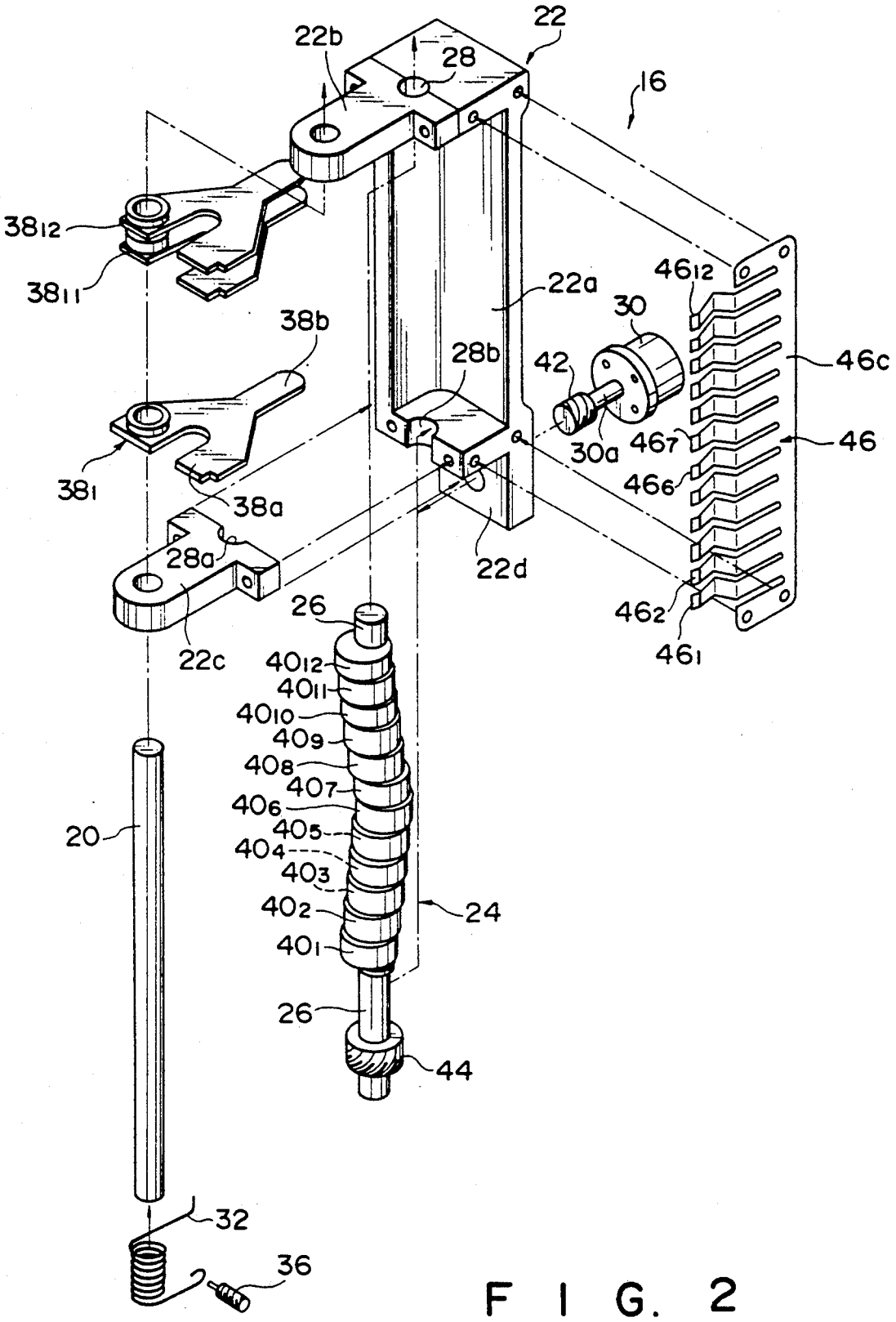
FIG. 2 is an exploded perspective view showing a liquid supply mechanism in the transfusion pump shown in FIG. 1.

On the other hand, the liquid supply mechanism 16 comprises a housing 22 pivotal about a pivot shaft 20 parallel to an extension direction of the tube 14 within the body 12. As shown in FIG. 2, the housing 22 comprises a connecting plate 22*a* extending in the extension direction of the tube 14, and a pair of side plates 22*b* and 22*c* standing upright from the upper and lower ends of the connecting plate 22*a* toward the tube 14. The pivot shaft 20 extends through the distal ends of the upper and lower side plates 22*b* and 22*c*.

The upper and lower side plates 22*b* and 22*c* are fixed to the connecting plate 22*a* through bolts (not shown). Semicircular recesses 28*a* and 28*b* are formed in joining surfaces between the upper and lower side plates 22*b* and 22*c* and the connecting plate 22*a*. Upon joining these plates, the recesses 28*a* and 28*b* define a circular support hole 28 into which a drive shaft 26 in a drive mechanism 24 (to be described later}is pivotally inserted. A table 22*d* on which a drive motor 30 in the drive mechanism 24 is placed is formed integrally with the lower end of the connecting plate 22*a*.

One end of a torsion coil spring 32 serving as a second biasing member wound around the pivot shaft 20 is locked in the housing 22. The housing 22 is normally biased clockwise by the biasing force of the torsion coil spring 32. In a state wherein the housing 22 receives the biasing force from the torsion coil spring 32, a stopper 34 formed on a finger (to be described later) abuts against the body 12, and its further pivotal movement through the cam can be prevented. The other end of the torsion coil spring 32 is locked to the distal end of a biasing force adjusting screw 36 (to be described later).

A plurality of fingers (12 fingers in this embodiment) $38_1$ to $38_{12}$ are stacked on each other to be rotatable on the pivot shaft 20 along the extension direction of the tube 14 between the upper and lower side walls 22*b* and 22*c*. The fingers $38_1$ to $38_{12}$ are made of horizontally extending plate-like members and are independently pivotal about the pivot shaft 20 within a horizontal plane. In this embodiment, a clockwise direction of pivotal movement of the fingers $38_1$ to $38_{12}$ in the illustrated state is defined as a direction to urge the tube 14, as indicated by an arrow A. A counterclockwise direction of pivotal movement is defined as a direction to separate the fingers from the tube 14.

In the following description, the fingers $38_1$ to $38_{12}$ have the same shape. Suffixes 1 to 12 are added to reference numeral 38 when the individual fingers must be distinguished from each other. However, when the shape of each finger is involved, reference numeral 38 without any suffixes is referred to.

Each finger 38 integrally comprises a press portion 38*a* for partially urging the tube 14 upon pivotal movement of the finger to one end portion opposite to the tube 14 along the urging direction A. A projection 38*b* extending outward is integrally formed with the other end portion of each finger 38 on the side opposite to the tube 14.

Twelve eccentric disc cams $40_1$ to $40_{12}$ abutting against the corresponding projections 38*b* are stacked upward along the extension direction of the tube 14 and are fixed on a drive shaft 26 obliquely below the fingers $38_1$ to $38_{12}$ in the same manner as the fingers $38_1$ to $38_{12}$.

The drive mechanism 24 is arranged to peristaltically reciprocate the fingers $38_1$ to $38_{12}$ upon rotation of the eccentric disc cams $40_1$ to $40_{12}$. The drive mechanism 24 comprises the drive shaft 26 pivotally supported in the support hole 28 formed in the housing 22, the drive motor 30 having a motor shaft 30*a* rotated about an axis perpendicular to the drive shaft 26, a worm gear 42 coaxially fixed on the motor shaft 30*a*, and a worm wheel 44 meshed with the worm gear 42 and coaxially fixed at the lower end of the drive shaft 26 extending through the lower side plate 22*c*.

The eccentric disc cams $40_1$ to $40_{12}$ corresponding to the fingers $38_1$ to $38_{12}$ are mounted on the drive shaft 26 between the upper and lower side plates 22*b* and 22*c*.

The twelve eccentric disc cams $40_1$ to $40_{12}$ are mounted so that moving amounts of the corresponding fingers $38_1$ to $38_{12}$ in the urging direction A are gradually changed upward and cyclically to restore the initial states upon rotation by 360°, i.e., so that the eccentric amounts or eccentric phase angles (each angle is measured clockwise when a rotational angle of the drive shaft 26 which defines a maximum eccentric amount in a 3 o'clock direction of FIG. 1 is given as 0°) are changed in units of 30°.

The stopper 34 is positioned so that the press portion 38*a* of the finger 38 of the 12 fingers $38_1$ to $38_{12}$ in a maximum eccentric state is brought into light contact with the tube mounting plate 18 when the tube 14 is not mounted.

Upon starting of the drive motor 30, the drive shaft 26 is driven clockwise in the drive mechanism 24, and the fingers $38_1$ to $38_{12}$ are peristaltically driven as a whole to gradually push the tube 14 upward. As a result, the liquid in the tube 14 pushed by the fingers $38_1$ to $38_{12}$ is supplied downward.

As shown in FIG. 1, taking the uppermost finger $38_{12}$ as an example, when an eccentric phase angle of the eccentric disc cam $40_{12}$ which is in rolling contact with the finger $38_{12}$ is 0°, the finger $38_{12}$ almost does not urge the tube 14. Note that the finger $38_{12}$ urges the tube 14 in a maximum urging amount when the eccentric phase angle is 180°, as shown in FIG. 3.

In other words, when the eccentric disc cam $38_{12}$ has an eccentric phase angle of 0° shown in FIG. 1, a finger (i.e., a finger having an eccentric phase angle of 0°) which urges the tube 14 in a maximum urging amount is the sixth finger $38_6$ from the bottom. A finger which urges the tube 14 by ½ the maximum urging amount (i.e., a finger having an eccentric phase angle of 90° or 270°) is the third or ninth finger $38_3$ or $38_9$ from the bottom.

Figure 3:
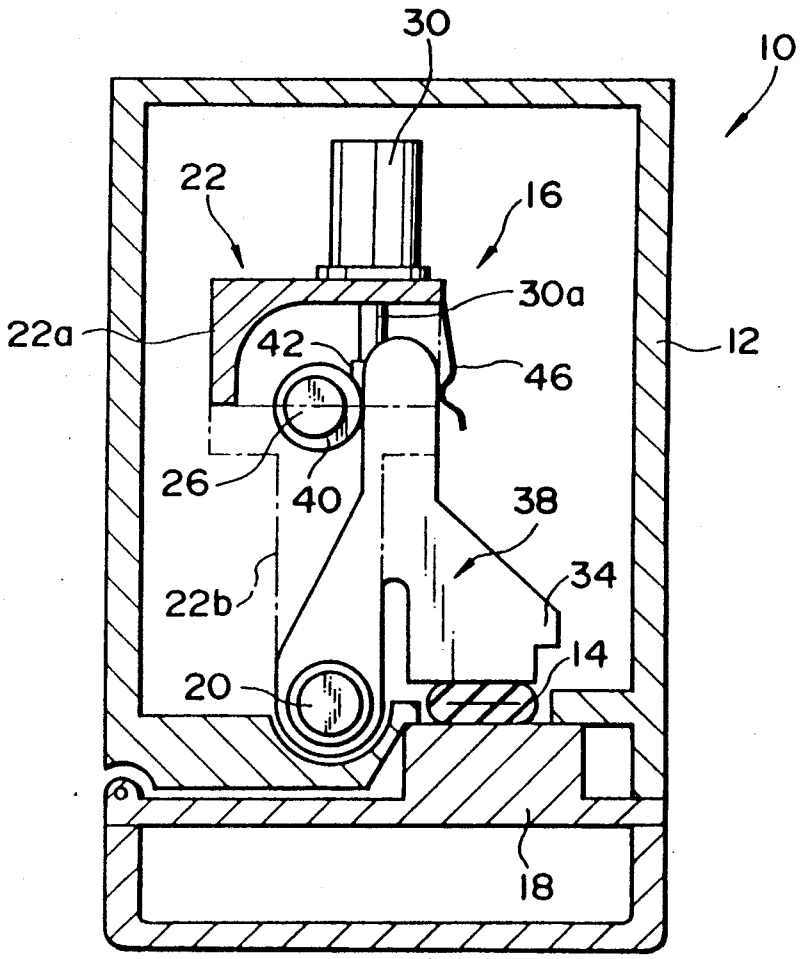
FIG. 3 is a sectional plan view showing the liquid supply mechanism shown in FIG. 2 set in a maximum eccentric state of an eccentric disc cam.

As is apparent from FIGS. 1 and 3, a leaf spring member 46 serving as a biasing member is mounted at a front surface portion of the housing 22 so as to keep the fingers $38_1$ to $38_{12}$ into contact with the corresponding eccentric disc cams $40_1$ to $40_{12}$. More specifically, as shown in FIG. 2, the leaf spring member 46*c* integrally comprises a mounting portion 46*c* mounted on the housing 22, and spring pieces $46_1$ to $46_{12}$, extending from the mounting portion 46*c*, for $40_{12}$. In this embodiment, the spring pieces $46_1$ to $46_{12}$ are set to be elastically brought into contact with the front surfaces of the projections 38*b* of the fingers $38_1$ to $38_{12}$, respectively.

As described above, according to the present invention, since the leaf spring member 46 is arranged, the fingers 38 and the eccentric cam 40 are normally in contact with each other. The fingers 38 can be reciprocally driven perfectly synchronized with the eccentric disc cams 40 without any lag time. In the tube 14 urged by these fingers 38, the liquid is appropriately supplied downward.

The fingers 38 are pivotally supported about the pivot shaft 20, and the sliding area of each finger 38 is very small. As a result, the frictional resistance during sliding can be minimized. In this manner, according to this embodiment, a torque generated by the drive motor 30 can be minimized, thereby achieving low power consumption and low manufacturing cost.

In this embodiment, as described above with reference to FIG. 4, the housing 22 is biased in the urging direction A by the biasing force of the torsion coil spring 32. When an urging force larger (stronger) than the biasing force defined by the torsion coil spring 32 is applied to the tube 14 due to variations in, e.g., size of the fingers 38, the reaction force is larger than the biasing force of the torsion coil spring 32. The housing 22 is then pivoted (backward) in the anti-urging direction (i.e., counterclockwise direction) against the biasing force of the torsion coil spring 32. In this manner, even if an excessive urging force acts on the housing 22, this force can be safely absorbed in the form of backward movement of the housing. The reaction force based on this excessive urging force does not adversely affect the drive system, and a driving failure can be perfectly prevented.

In a conventional arrangement, as disclosed in Japanese Patent Laid-Open No. 61-85593, in order not to adversely affect a drive system upon application of an excessive force of fingers to a tube, a plurality of springs are interposed between a tube reception plate and a lid. In practice, when a force actually urges the tube with an excessive force, the springs contract in accordance with the magnitude of the excessive force, thereby absorbing the excessive force. In a transfusion pump described in Japanese Patent Laid-Open No. 61-85593, when the excessive urging force is generated, the springs near a portion which receives this force contract. As a result, the reception plate is inclined as a whole. When the reception plate is inclined as described above, a parallel relationship between the surfaces of the fingers and the reception plate to clamp the tube therebetween cannot be maintained, thus forming a predetermined angle. That is, a nonuniform urging force acts on the tube between the fingers and the reception plate. Therefore, upon urging of the tube, the tube is escaped in a direction where an urging force is weak, and zig-zag movement of the tube and flow rate variations tend to occur.

In this embodiment, however, when an excessive force is generated, the housing 22 as a whole is moved backward. The fingers 38 mounted on the housing 22 are also spaced apart from the tube 14. As a result, zig-zag movement of the tube 14 and flow rate variations can be effectively prevented.

According to this embodiment, the biasing force of the torsion coil spring 32 can be set to be an arbitrary value upon reciprocal driving of the adjusting screw 36. The biasing force of the torsion coil spring 32 can be caused to accurately correspond to any excessive urging force which adversely affects the drive system, thereby providing a good advantage.

The present invention is not limited to the arrangement of this embodiment, but various changes and modifications may be made without departing from the spirit and scope of the invention.

Figure 5:
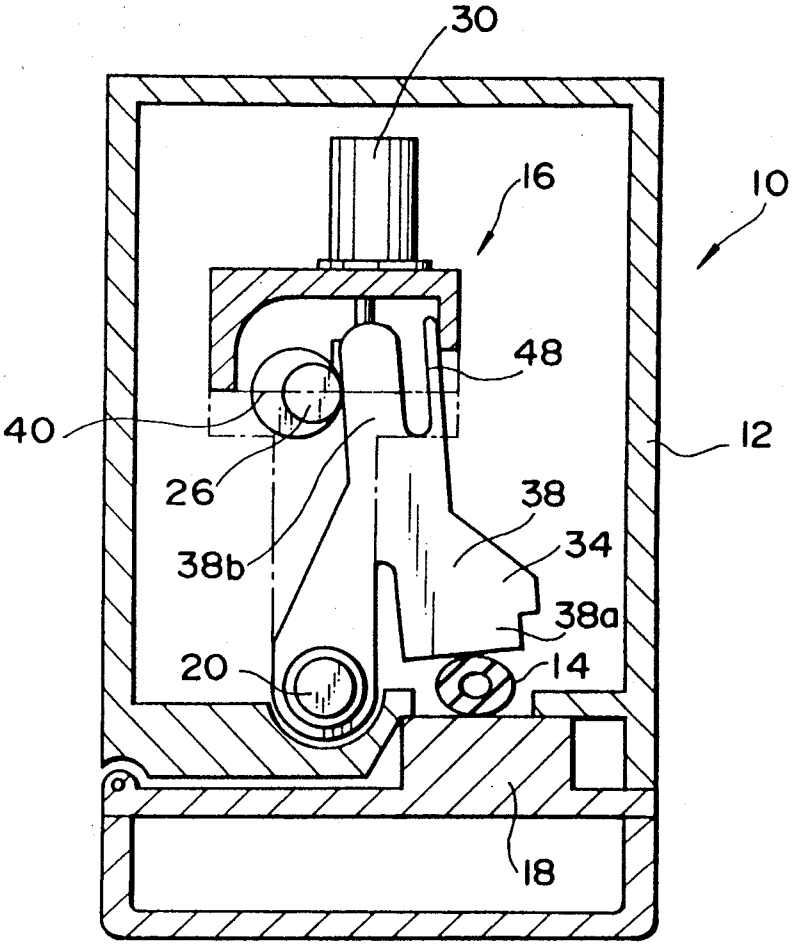
FIG. 5 is a sectional plan view schematically showing an arrangement of a transfusion pump according to another embodiment of the present invention.
Figure 4:
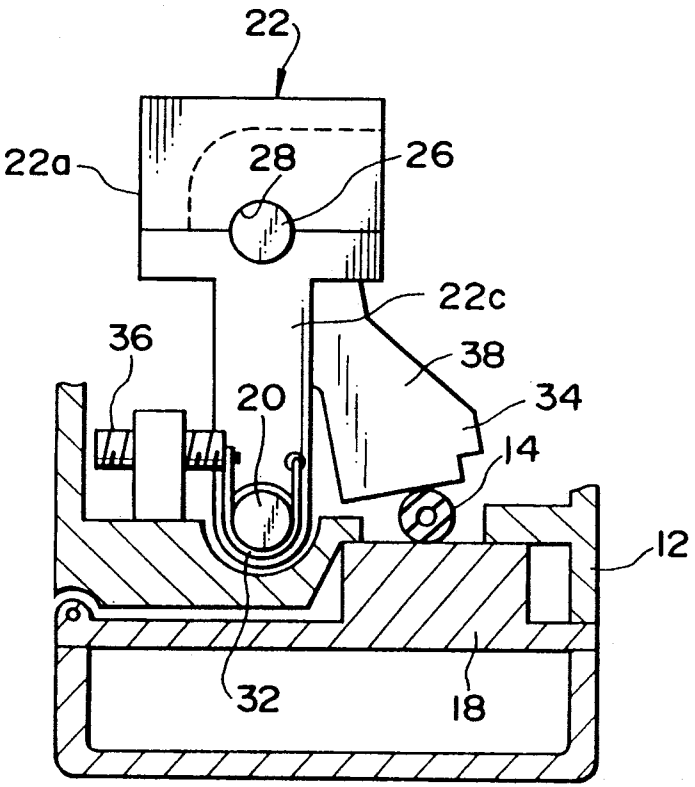
FIG. 4 is a bottom view showing a mounting state of a torsion coil spring.
Figure 6:
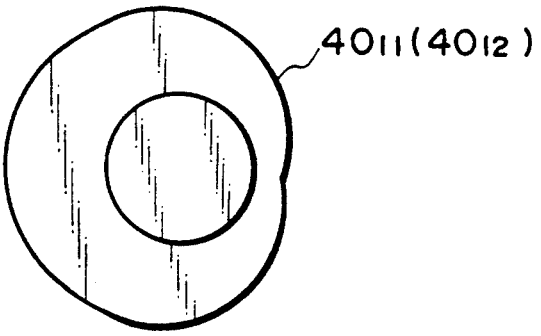
FIG. 6 is a front view showing the shape of a pulsation preventive cam.

In the above embodiment, the leaf spring member 46 is used as a biasing member for from causing the fingers $38_1$ to $38_{12}$ to be normally in contact with the eccentric disc cams $40_1$ to $40_{12}$. However, the present invention is not limited to this arrangement. For example, as shown in another embodiment of FIG. 5, a spring member 48 as a biasing member may be formed to extend adjacent to a projection 38*b* of each finger 38. The distal end of the spring member 48 may be locked on one side of a housing 22, as shown in FIG. 5, thereby obtaining the same effect as in the above embodiment.

In the above embodiment, all the fingers $38_1$ to $38_{12}$ are involved in the liquid supply operation. The present invention is, however, not limited to this. For example, the fingers $38_1$ to $38_{10}$ may be defined as fingers to actually supply the liquid, while the fingers $38_{11}$ and $38_{12}$ may serve as pulsation preventive fingers for preventing pulsation during liquid supply.

Still another embodiment having a pulsation preventive function will be described below with reference to FIGS. 6 to 9. The same reference numerals as in the previous embodiments denote the same parts in FIGS. 6 to 9, and a detailed description thereof will be omitted.

When a liquid is to be supplied by a peristaltic pump, a predetermined dead time in which a liquid is not delivered to the delivery side is generally included in one pumping cycle and appears as a pulsation phenomenon. This pulsation is inconvenient for transfusion. The fingers $38_{11}$ and $38_{12}$ serve as pulsation preventive fingers to prevent this pulsation.

In this case, the eccentric disc cams $40_1$ to $40_{10}$ which abut against the fingers $38_1$ to $38_{10}$ have the same shape. However, unlike the above embodiment, the eccentric disc cams $40_1$ to $40_{10}$ are mounted on a drive shaft 26, offsetting from each other in units of 36°. The pulsation preventive cams $40_{11}$ and $40_{12}$ which abut against the pulsation preventive fingers $38_{11}$ and $38_{12}$ are formed in a form shown in FIG. 6. The stroke of each of the pulsation preventive cams $40_{11}$ and $40_{12}$ is shorter than that of each of the eccentric disc cams $40_1$ to $40_{10}$.

Figure 7:
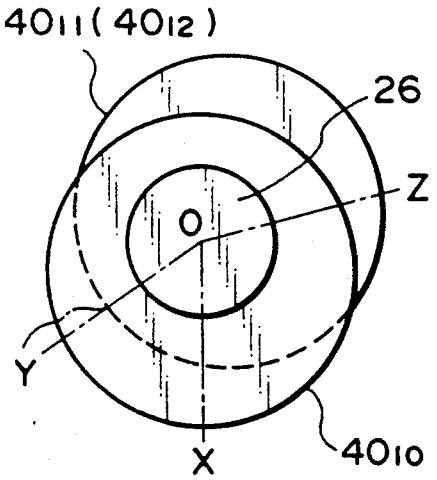
FIG. 7 is a front view showing a positional relationship between eccentric disc cams $\mathbf{40}_{10}$, $\mathbf{40}_{11}$, and $\mathbf{40}_{12}$.

The positional relationship of the eccentric disc cams $40_{10}$, $40_{11}$, and $40_{12}$ is set, as shown in FIG. 7. That is, the central point of the shaft in FIG. 7 is defined as O, the central point of the arcuated surface of the eccentric disc cam $40_{10}$ is defined as X, a point nearest from the center O of the shaft of the arcuated surface of each of the eccentric disc cams $40_{11}$ and $40_{12}$, i.e., the bottom dead center, is defined as Y, and a point farthest from the center O of the shaft, i.e., the top dead center, is defined as Z. Under these conditions, an optimal positional relationship is set so that an angle ∠XOY is 55° and an angle ∠XOZ is 105.4°.

Figure 8:
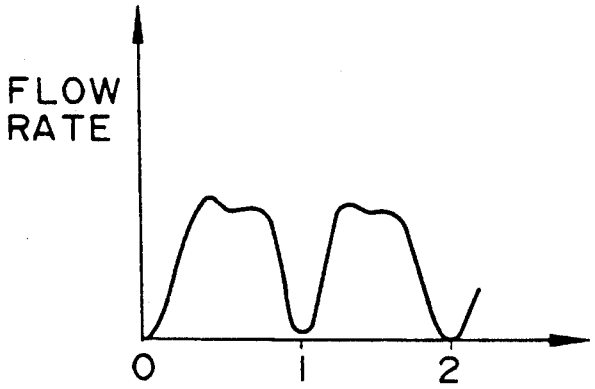
FIG. 8 is a graph showing a state in change in flow rate of the transfusion liquid.
Figure 9:
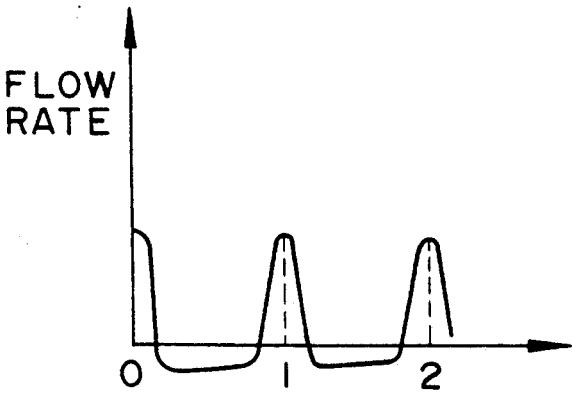
FIG. 9 is a graph showing a pulsation preventive waveform.

As described above, when the liquid is supplied by the fingers $38_1$ to $38_{10}$, a flow rate of the liquid for the eccentric disc cams $40_1$ to $40_{10}$ is changed to cause so-called pulsation, as shown in FIG. 8. When a pulsation preventive waveform having the opposite magnitude is formed, as shown in FIG. 9, the pulsation can be canceled to obtain a predetermined transfusion waveform. The pulsation preventive waveform is formed by the pulsation preventive cams $40_{11}$ and $40_{12}$.

When a flow rate is reduced during liquid supply by the fingers $38_1$ to $38_{10}$, the pulsation preventive fingers $38_{11}$ and $38_{12}$ urge the tube 14, and a flow rate at the delivery side is increased by a volume corresponding to a deformation amount of the tube 14. In this case, the top dead centers Z of the pulsation preventive cams $40_{11}$ and $40_{12}$ urge the pulsation preventive fingers $38_{11}$ and $38_{12}$. In a liquid supply waveform, the pulsation preventive fingers $38_{11}$ and $38_{12}$ are gradually separated from the tube at a timing corresponding to a large flow rate. At this time, the pulsation preventive cam $40_{11}$ is rotated such that the top dead center Z is shifted and is replaced with the bottom dead center Y.

As the pulsation preventive fingers $38_{11}$ and $38_{12}$ are shifted in a separation direction, the tube 14 is restored by its elastic force, and the liquid is reduced by an amount corresponding to the deformation amount of the tube 14. In this manner, at the delivery side, compression and expansion of the tube 14 are performed in accordance with a liquid supply waveform, thereby obtaining a predetermined transfusion amount at the delivery side.

Note that the method disclosed in Japanese Patent Laid-Open No. 56-113083 is incorporated as the method of obtaining a shape of the pulsation preventive cam in the present invention.

As many apparently widely different embodiments of the present invention can be made without departing from the spirit and scope thereof, it is to be understood that the invention is not limited to the specific embodiments thereof except as defined in the appended claims.

What is claimed is:

1. A transfusion pump which comprises:

a housing disposed to oppose a tube that is to be filled with a liquid;

a plurality of fingers mounted on said housing along a liquid supply direction for urging said tube, each of said fingers including a press portion for contacting said tube and a projection portion;

pivoting means for pivotally supporting said fingers so as to reciprocate in a direction wherein said press portion of each finger is capable of urging said tube;

a plurality of cams, each of said cams being engageable with the projection portion of one of said fingers, the projection portion of each finger being spaced farther from said pivoting means than said press portion;

driving means for sequentially driving said cams so that said fingers which are engaged with the corresponding cams sequentially urge said tube in the liquid supply direction; and a biasing member, arranged to be engaged with said fingers, for biasing said fingers to be in contact with the corresponding cams, said biasing member comprising elastic pieces mounted on said housing in correspondence with said fingers, respectively, said biasing member urging the projection portion of each of said fingers.

2. The transfusion pump according to claim 1, wherein said housing is movably supported along the tube urging direction, and said transfusion pump further comprises a second biasing member for urging said housing in the tube urging direction.

3. The transfusion pump according to claim 2, wherein said housing is pivotally rotated about a pivot shaft which axially supports said fingers, and said second biasing member comprises a torsion coil spring which is wound around said pivot shaft and one end of which is locked by said housing.

4. The transfusion pump according to claim 3, which further comprises an adjusting screw connected to the other end of said torsion coil spring and reciprocated to adjust a biasing force of said torsion coil spring.

5. The transfusion pump according to claim 1, which further comprises at least one pulsation preventive finger located adjacent to said fingers and opposite to said tube, and a pulsation preventive cam in contact with said pulsation preventive finger to drive said pulsation preventive finger so as to prevent pulsation during liquid supply, thereby pushing said tube.

6. The transfusion pump according to claim 5, wherein said pulsation preventive finger is pivotally supported by said pivoting means.

* * * * *